United States Patent [19]

Alfredson

[11] Patent Number: 4,955,647

[45] Date of Patent: Sep. 11, 1990

[54] LOG HANDLING TOOL

[76] Inventor: Henry Alfredson, 5-34th St., Stony Brook, N.Y. 11790

[21] Appl. No.: 396,063

[22] Filed: Aug. 21, 1989

[51] Int. Cl.[5] ..... A47J 49/00; B65G 7/12

[52] U.S. Cl. ..... 294/14; 294/26

[58] Field of Search ..... 294/2, 3.6, 5.5, 9–12, 294/14–18, 19.1, 25, 26, 61

[56] References Cited

U.S. PATENT DOCUMENTS

| | | | |
|---|---|---|---|
| 901,057 | 10/1908 | Autenrieth | 294/26 |
| 1,386,929 | 8/1921 | Hartman | 294/16 |
| 1,555,605 | 9/1925 | Pomeroy | 294/26 |
| 1,562,034 | 11/1925 | Mieher | 294/26 |
| 1,710,575 | 4/1929 | Grant | 294/26 |
| 1,857,841 | 5/1932 | Engel | 294/11 |
| 1,910,725 | 5/1933 | Valenta | 294/11 |
| 2,482,314 | 9/1949 | Beckwell | 294/26 |
| 2,882,084 | 4/1959 | Eatinger | 294/26 |
| 3,042,438 | 7/1962 | Turner | 294/11 |
| 3,310,331 | 3/1967 | Michaud | 294/26 |
| 3,574,380 | 4/1971 | Tague | 294/26 X |
| 4,307,909 | 12/1981 | Yaworski | 294/11 |
| 4,560,194 | 12/1985 | Rybeck | 294/26 X |
| 4,574,512 | 3/1986 | Hahn | 294/26 X |
| 4,773,686 | 9/1988 | Michaud | 294/26 X |

FOREIGN PATENT DOCUMENTS

| | | | |
|---|---|---|---|
| 493307 | 6/1953 | Canada | 294/26 |
| 538565 | 3/1957 | Canada | 294/26 |
| 121511 | 7/1927 | Switzerland | 294/26 |
| 2201115 | 8/1988 | United Kingdom | 294/15 |

*Primary Examiner*—Johnny D. Cherry

*Attorney, Agent, or Firm*—Jerry T. Kearns

[57] ABSTRACT

A log handling tool for manipulating logs in fireplaces and wood stoves is formed from an elongated metal rod. A handle is formed by an arcuate loop bend at an end of the rod. An opposite end of the rod includes two bend portions forming first and second legs. The first leg extends transversely to the rod and the second leg forms an acute angle with the first leg. The second leg terminates in a pointed tip directed upwardly toward the rod. In use, the pointed tip is engaged with an end face of a log, with the rod extending parallel along the outer surface of the log.

1 Claim, 1 Drawing Sheet

LOG HANDLING TOOL

BACKGROUND OF THE INVENTION

1. Field of the Invention

The present invention relates to log handling tools, and more particularly pertains to an improved log handling tool for manipulating logs in fireplaces and wood stoves. While positioning logs on a fire, they frequently become wedged between other logs or otherwise misplaced. Various forms of fireplace tools include elongated metal rods for pushing and poking logs into place. However, these conventional fireplace implements do not provide an adequate engagement with the log to enable a safe and expeditious placement of the log in proper position on the fire. Other forms of log handling tools include various tong mechanisms for circumferentially gripping a log. These devices are relatively expensive, complex, and are excessively heavy for most individuals to conveniently manipulate. In order to overcome these problems, the present invention discloses a simple, yet novel and effective form of log handling hook for safely and effectively manipulating logs on fires and wood stoves.

2. Description of the Prior Art

Various types of log handling tools are known in the prior art. A typical example of such a log handling tool is to be found in U.S. Pat. No. 3,042,438, which issued to J. Turner on July 3, 1962. This patent discloses a fireplace tool including an elongated metal rod having a transverse leg at one end for manipulating a fireplace log. U.S. Pat. No. 3,310,331 which issued to H. Michaud on Mar. 21, 1967, discloses a U-shaped hook having a D ring type handle for manipulating a log. U.S. Pat. No. 3,574,380, which issued to R. Tague on Apr. 13, 1971, discloses a fireplace log handling tool including two separate arms, each of which is engageable by a hand of a user for engaging opposite end faces of a log. Each of the arms terminates in a transverse leg having a pointed tip. U.S. Pat. No. 4,560,194, which issued to T. Rybeck on Dec. 24, 1985, discloses a log handling tool for mounting upon an axe-type handle. The log handling tool includes a laterally extending hook member having an offset tip portion. U.S. Pat. No. 4,773,686, which issued to H. Michaud on Sep. 27, 1988, discloses a wood handling hook having a tip including a plurality of flutes forming shoulders to enhance engagement in a log.

While the above mentioned devices are directed to log handling tools, none of these devices disclose a log handling tool including an elongated metal rod having a first transverse leg portion connected by a 90 degree bend with a second leg terminating in a pointed tip. Inasmuch as the art is relatively crowded with respect to these various types of log handling tools, it can be appreciated that there is a continuing need for and interest in improvements to such log handling tools, and in this respect, the present invention addresses this need and interest.

SUMMARY OF THE INVENTION

In view of the foregoing disadvantages inherent in the known types of log handling tools now present in the prior art, the present invention provides an improved log handling tool. As such, the general purpose of the present invention, which will be described subsequently in greater detail, is to provide a new and improved log handling tool which has all the advantages of the prior art log handling tools and none of the disadvantages.

To attain this, a representative embodiment of the concepts of the present invention is illustrated in the drawings and makes use of a log handling tool for manipulating logs in fireplaces and wood stoves which is formed from an elongated metal rod. A handle is formed by an arcuate loop bend at an end of the rod. An opposite end of the rod includes two bend portions forming first and second legs. The first leg extends transversely to the rod and the second leg forms an acute angle with the first leg. The second leg terminates in a pointed tip directed upwardly toward the rod. In use, the pointed tip is engaged with an end face of a log, with the rod extending parallel along the outer surface of the log.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and those who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved log handling tool which has all the advantages of the prior art log handling tools and none of the disadvantages.

It is another object of the present invention to provide a new and improved log handling tool which may be easily and efficiently manufactured and marketed.

It is a further object of the present invention to provide a new and improved log handling tool which is of a durable and reliable construction.

An even further object of the present invention is to provide a new and improved log handling tool which is susceptible of a low cost of manufacture with regard to both materials and labor, and which accordingly is then susceptible of low prices of sale to the consuming public, thereby making such log handling tools economically available to the buying public.

Still yet another object of the present invention is to provide a new and improved log handling tool which provides in the apparatuses and methods of the prior art some of the advantages thereof, while simultaneously overcoming some of the disadvantages normally associated therewith.

Still another object of the present invention is to provide a new and improved log handling tool to enable individuals to safely place logs in the proper position within wood stoves and fireplaces.

Yet another object of the present invention is to provide a new and improved log handling tool which is of a sturdy construction, yet light in weight to allow convenient manipulation.

Even still another object of the present invention is to provide a new and improved log handling tool having an elongated shank portion terminating in a first transverse leg which is connected by an acute angle bend with a second leg terminating in an upwardly directed pointed tip for affording a secure engagement with an end face of a log.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanYing drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
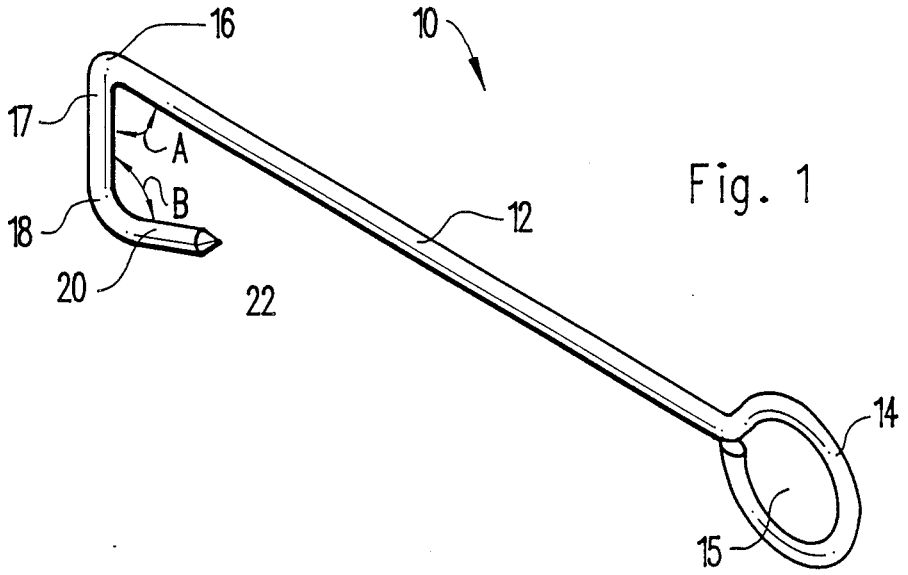
FIG. 1 is a perspective view of the log handling tool of the present invention.

With reference now to the drawings, and in particular to FIG. 1 thereof, a new and improved log handling tool embodying the principles and concepts of the present invention and generally designated by the reference numeral 10 will be described.

More specifically, it will be noted that the first embodiment 10 of the invention includes an elongated metal rod 12, preferably constructed from a hardened steel material. The rod 12 terminates at one end in a handle 14 formed by an arcuate loop bend. The handle 14 forms a hand grip insertion opening 15 for convenient engagement with the hand of a user. An opposite end of the handle 14 terminates in a bend 16 forming a transverse first leg 17. The first leg 17 forms an angle A of about 90 degrees with the metal rod 12. A second leg 20 is connected by a radiused bend 18 to the first leg 17. The second leg 20 forms an angle B which is less than 90 degrees, preferably on the order of about 60 to 75 degrees. The second leg 20 terminates in an upwardly directed pointed tip 22 adapted for engagement with an end face of a log. The handle 14, rod 12, first leg 17 and second leg 20 all lie in a common plane. The metal rod 12, first leg 17 and second leg 20 may be formed of a wide variety of different dimensions, for use with various different sizes of logs.

Figure 2:
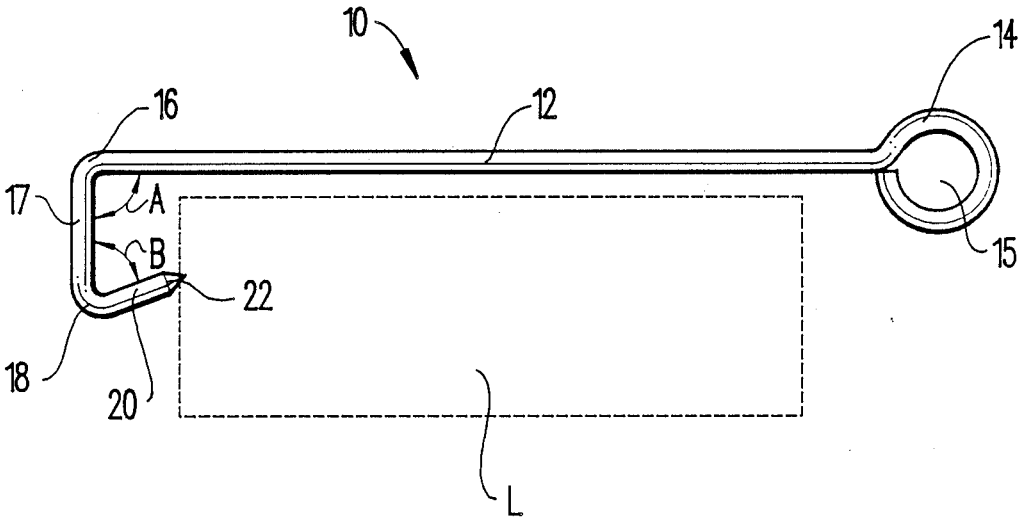
FIG. 2 is a side view illustrating the manner of use of the fireplace tool of the present invention.

FIG. 2 illustrates the manner of use of the log handling tool 10 of the present invention. The metal rod 12 is gripped by the handle portion 14 and placed into a generally parallel relation with a log L. The pointed tip 22 is engaged with the end face of the log L, preferably at an approximately central position. The individual then is provided with a sufficient leverage to move the log upwardly, or laterally. To carry the log L, an individual may place the other hand into engagement with a bottom surface of the log L. The upwardly directed leg 20 ensures that the tip 22 will remain engaged with the end face of the log L when the log is lifted or moved from side to side.

As may now be understood, the present invention provides an inexpensive, simple, yet safe and efficient tool for correctly positioning logs within fireplaces and wood stoves.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the U.S. is as follows:

1. A log handling tool for manipulating logs in fireplaces and wood stoves, comprising:

an elongated metal rod;

a handle portion formed by an arcuate loop bend at an end of said rod;

a first straight leg formed by a 90 degree bend at an end of said rod opposite said handle;

a straight shank portion of said rod extending between said handle portion and said first leg;

a second straight leg formed by a bend in an end portion of said first leg, said second leg forming an included angle between 60 and 75 degrees with said first leg and extending toward said shank portion;

a pointed tip formed on a free end of said second leg; and said rod, said handle, said first leg and said second leg all lying in a common plane.

* * * * *